US005904475A

United States Patent [19]

Ding

[11] Patent Number: 5,904,475

[45] Date of Patent: May 18, 1999

[54] DUAL OXIDANT COMBUSTION SYSTEM

[75] Inventor: Maynard Guotsuen Ding, Yorktown Heights, N.Y.

[73] Assignee: Praxair Technology, Inc., Danbury, Conn.

[21] Appl. No.: 08/848,412

[22] Filed: May 8, 1997

[51] Int. Cl.[6] ..... F23C 5/00

[52] U.S. Cl. ..... 431/8; 431/10; 431/187

[58] Field of Search ..... 431/187, 188, 431/10, 8

[56] References Cited

U.S. PATENT DOCUMENTS

| | | | |
|---|---|---|---|
| Re. 33,464 | 11/1990 | Gitman | 431/10 |
| 4,622,007 | 11/1986 | Gitman | 431/10 |
| 4,797,087 | 1/1989 | Gitman | 431/10 |
| 4,878,829 | 11/1989 | Anderson | 431/8 |
| 4,907,961 | 3/1990 | Anderson | 431/8 |
| 4,933,163 | 6/1990 | Fisher et al. | 431/8 |
| 5,308,239 | 5/1994 | Bazarian et al. | 431/10 |
| 5,597,298 | 1/1997 | Snyder et al. | 431/8 |
| 5,611,683 | 3/1997 | Baukal et al. | 431/187 |
| 5,743,723 | 4/1998 | Iatrides et al. | 431/8 |

OTHER PUBLICATIONS

Krichten et al., "$O_2$ Enhances Melting in Aluminum Reverb Furnaces", 33 Metal Producing, pp. 43, 44 (1994).

*Primary Examiner*—Carroll B. Dority
*Attorney, Agent, or Firm*—Stanley Ktorides

[57] ABSTRACT

A dual oxidant burner having an inner conduit with a passage communicating with a source of fuel, an outer conduit over the inner conduit and an intermediate conduit between the inner and outer conduits. The three conduits form an inner passage between the inner and intermediate conduits communicating with a source of oxygen, and an outer passage between the intermediate and outer conduits communicating with a source of air. The fuel and the two oxidants are mixed in a furnace or other combustion zone beyond the outlet of the nozzle and the two passages and their flow amounts are individually adjusted to establish the burner flame.

4 Claims, 1 Drawing Sheet

DUAL OXIDANT COMBUSTION SYSTEM

FIELD OF THE INVENTION

The present invention relates generally to oxy-fuel combustion and more particularly to oxy-fuel combustion which additionally provides air to the combustion reaction.

BACKGROUND OF THE INVENTION

A number of combustion processes for a furnace use a burner supplied with air as an oxidizer in combination with a fuel, such as natural gas, fuel oil, propane, waste oils, other hydrocarbons, and the like. Attempts have been made to improve the performance of such air combustion processes by enriching the combustion atmosphere with oxygen enriched air, or pure oxygen gas. Oxygen enrichment of the combustion air increases both the burner flame temperature and the thermal efficiency while the furnace flue gas volume decreases as the oxygen concentration in the air or oxidizing gas increases.

It is known that even low level oxygen enrichment in the combustion process can cause a dramatic increase in undesirable nitric oxide ($NO_x$) emissions. In industrial combustion processes, over 90% of the $NO_x$ emissions are in the form of nitric oxide or NO. High levels of oxygen enrichment, e.g., above 90% total oxygen content in the oxidizer, could result in the production of less $NO_x$ than using air for the same burner firing rate. However, high levels of oxygen enrichment are costly to implement.

Further, when oxygen is used to replace the air for combustion, it often causes problems, such as furnace refractory damage, uneven temperature distribution, and high $NO_x$ emission due to high flame temperature. In specialized applications of metal processing, especially in aluminum remelting, another related problem occurs, namely excess oxidation of the metal load.

Conventionally, one approach used to enrich the oxygen content of the combustion process is to install an oxy-fuel burner in the center of the existing air-fuel burner. This has a disadvantage in that it results in a relatively complex construction. Further, in such a burner it is difficult to control the two fuel streams and, at the same time, to adjust both the air and the oxygen for matching the fuel streams. Another approach is to design an oxy-fuel burner which can utilize a high level of oxygen as an oxidant and yet still maintain a moderate flame temperature and low $NO_x$ emissions. This involves a new burner installation involving more work which can be difficult and costly.

Accordingly, a need exists to develop a system as a retrofit to an existing air burner system to enable the use of both oxygen and air for combustion without causing the undesired adverse affects associated with using only pure oxygen as the oxidant.

BRIEF DESCRIPTION OF THE INVENTION

The present invention relates to a retrofit system for an existing air-fuel burner to provide a second oxidant source. The invention provides a simple design which permits retrofitting to an existing air combustion system which can moderate and control the flame temperature when using oxygen. In accordance with the invention, a conventional burner having an inner conduit serving as a fuel passage and an outer conduit which defines with the inner conduit a passage for air flow, is modified to add a conduit between the inner and outer conduits. This provides an additional passage between the outer and added conduit for a source of oxygen, which is used to improve the combustion process. Each oxidant flow and the fuel flow can be individually controlled to adjust the burner combustion characteristics and particularly to add a source of oxygen such that the production of $NO_x$ can be reduced. The invention is a simple retrofitting rather than a new installation, and results in lower capital costs and minimum furnace downtime during the installation.

One aspect of the invention is:

A dual oxidant burner comprising:

an inner conduit communicating with a source of fuel, through which fuel flows, and having a nozzle at its exit end;

an outer conduit surrounding at least a portion of the length of said inner conduit and an intermediate conduit between said inner and outer conduits, the outer and intermediate conduits defining a first passage between said inner and intermediate conduits communicating with a source of oxygen, and a second passage between said intermediate and outer conduits communicating with a source of air, each of said first and second passages having an outlet end adjacent said nozzle;

each of said first and second passages conveying respective oxidants to mix beyond the outlet ends thereof with the fuel from the nozzle.

Another aspect of the invention is:

A combustion method employing dual oxidants comprising:

(A) passing fuel at a high velocity into a combustion zone containing furnace gases and aspirating gases into the high velocity fuel;

(B) passing oxygen into the combustion zone in a stream annular to the fuel;

(C) passing air into the combustion zone in a stream annular to the oxygen;

(D) mixing oxygen and air with the mixture of fuel and furnace gases to form a combustible mixture; and (E) combusting the combustible mixture within the combustion zone.

Yet another aspect of the invention is:

A combustion method employing dual oxidants comprising:

(A) passing oxygen at a high velocity into a combustion zone containing furnace gases and aspirating furnace gases into the high velocity oxygen;

(B) passing fuel into the combustion zone in a stream annular to the oxygen;

(C) passing air into the combustion zone in a stream annular to the fuel in an amount less than that required to completely combust the fuel and combusting the air with the fuel to form a mixture comprising combustion products and unburned fuel;

(D) mixing the mixture comprising combustion products and unburned fuel with the mixture of oxygen and furnace gases to form a combustible mixture; and (E) combusting the combustible mixture within the combustion zone.

As used herein, the term "oxygen" means a gaseous fluid having an oxygen concentration of at least 30 mole percent. It may have an oxygen concentration exceeding 85 mole percent or may be commercially pure oxygen having an oxygen concentration of 99.5 mole percent or more.

OBJECTS OF THE INVENTION

It is an object of the invention to provide a dual oxidant combustion system capable of producing low $NO_x$ output for a furnace.

A further object is to provide a retrofit for an existing air-fuel burner to convert it to a dual oxidant burner.

Another object is to provide a dual oxidant burner formed by adding to a conventional air-fuel burner an arrangement for supplying oxygen.

DETAILED DESCRIPTION OF THE DRAWINGS

Figure 1:
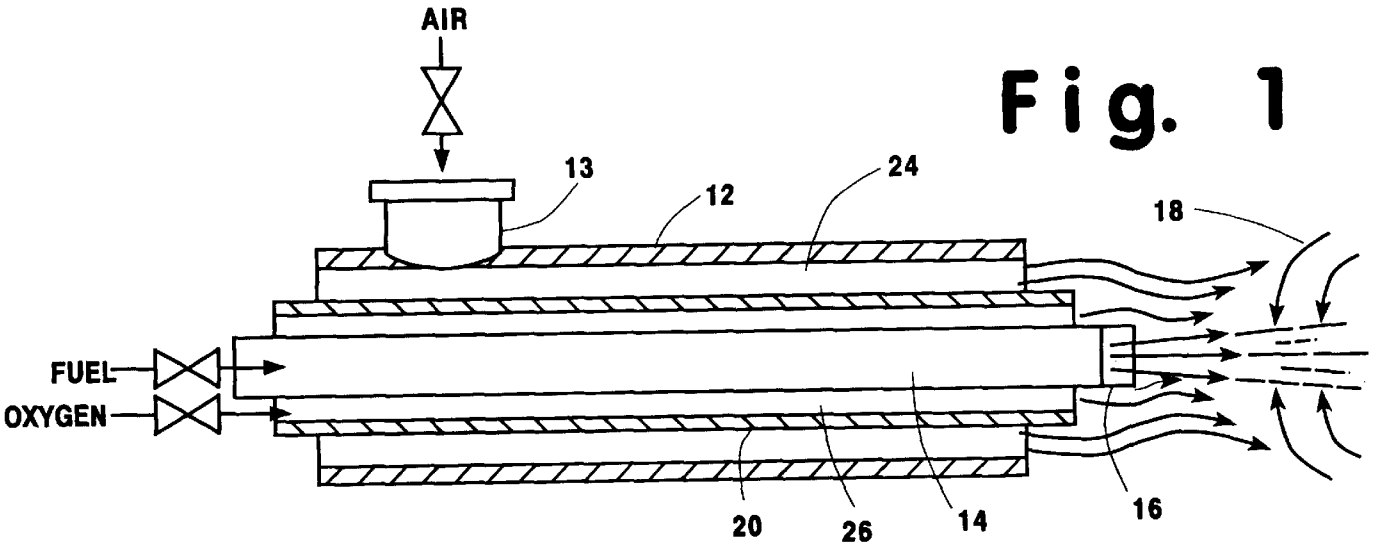
Figure 2:
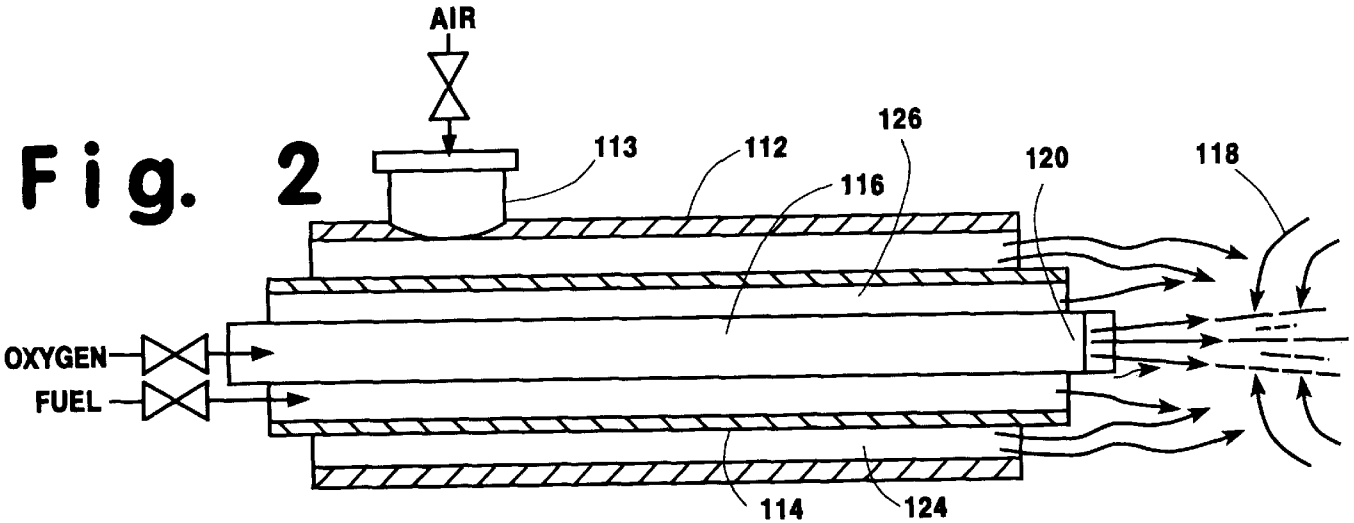

Other objects and advantages of the invention will become more apparent upon reference to the following specification and annexed drawings in which:

FIG. 1 is a view of a burner for the practice of one embodiment of the invention; and FIG. 2 is a view of another burner for the practice of another embodiment of the invention.

DETAILED DESCRIPTION OF THE INVENTION

FIG. 1 shows the parts of a conventional air-fuel burner which includes an outer conduit 12 and an inner conduit 14. In the conventional air-fuel burner, the inner conduit 14 communicates with and receives fuel from a source (not shown), and has an end nozzle 16 of any suitable type through which the fuel is ejected under pressure into a furnace or combustion zone. The fuel can be of any suitable type, for example, natural gas, other hydrogen-carbon fuel gases, coke oven gas, oil, etc. In a conventional burner, an oxidant such as air is supplied in the annular passage between the inner surface of the outer tubular conduit 12 and the outer surface of the inner tubular conduit 14.

In accordance with the invention, a middle conduit, or pipe, 20, is fitted around the inner fuel conduit 14 in the space between the inner and outer conduits. This forms an outer annular passage 24 between the outer conduit 12 and the middle conduit 20, and an inner annular passage 26 between the middle conduit 20 and the inner fuel conduit 14. With the arrangement shown, the fuel exits from the openings of the nozzle 16. The fuel is surrounded by oxygen flowing through the inner annular passage 26 which communicates with a source of oxygen (not shown). The air which flows through the outer annular passage 24 is partially mixed with the fuel at the burner front. Passage 24 by means of passage 13 communicates with a source of air (not shown). There can be separate control devices, such as the valves shown, either manual or automatic, to control the flow in each of the fuel conduit 14 and the annular passages 24 and 26. The air/oxygen/fuel flow can be adjusted individually since each is from a separate source and each has its own flow passage.

The end of the fuel conduit nozzle 16 is illustratively shown as extending beyond the outlet end of the inner annular passage 26. But this is not critical and the two ends can be flush. The end of the middle conduit 20 is shown extending beyond the end of the outer conduit 12, but this arrangement also is not critical.

Fuel flowing through the inner conduit 14 is at a predetermined velocity, while the oxygen flowing through the inner annular passage 26 and air through the outer annular passage 24 can be at different, but lower, velocities. This has the advantage in that oxygen can be provided at a reduced pressure, which can be a cost saving due to the lower compressing power required.

The velocity of the fuel from the inner conduit 14 can be varied over a wide range. Low $NO_x$ generation and moderate flame temperature can be achieved by having the fuel velocity equal to or greater than 400 ft/sec. Furnace gases 18, e.g. combustion reaction products, nitrogen, etc., are aspirated into the fuel gas stream rather than the streams of the two oxidants prior to combustion.

In the preferred manner of operating the dual oxidant combustion system of the invention, a minimum amount of air (for the purpose of cooling the outer conduit 12) and a maximum amount of oxygen for a given fuel input, are employed resulting in high thermal efficiency, good heat transfer and high total heat input to the furnace.

Under certain circumstances, when the furnace does not require the high heat input and/or when the oxygen supply is limited, the oxygen input can be cut back substantially, and the dual oxidant burner will be functioning in approximation to an air burner. This provides a wide latitude of flexibility for furnace operation and control.

Ranges of conditions and process variations can affect the performance of the dual oxidant burner of the invention. These include the relative amount of oxygen and air and the ratio of fuel velocity to oxygen velocity. For a given fuel input, the total amount of oxidants to be provided should be so as to provide at least 5% more oxygen molecules than stoichiometrically required for complete combustion of the fuel. Relative amounts of oxygen from passage 26 to the amount of oxygen molecules in the air from passage 24 air can be expressed as follows:

| | (A) | (B) | (C) | (D) | (E) | (F) | (G) | (H) | (I) |
|---|---|---|---|---|---|---|---|---|---|
| $O_2$ | 90% | 80% | 70% | 60% | 50% | 40% | 30% | 20% | 10% |
| air | 10% | 20% | 30% | 40% | 50% | 60% | 70% | 80% | 90% |

Condition (A) represents an oxy-fuel operation with a small amount of cooling air passing through the air passage 24. The minimum amount of cooling air depends on burner size and furnace conditions such as temperature and pressure. The 90%–10% split shown in condition (A) is for illustration purposes. At the other end of the table, condition (I) approximates an air burner operation.

Any of the above conditions ((A) to (I)) are applicable for the dual oxidant burner of the invention. The preferred mode of operation depends on the process requirement, production demands, furnace conditions, local emissions regulations and/or oxygen availability. From the combustion efficiency and/or heat transfer points of view, however, it is preferable to operate the burner in a manner wherein at least 80 percent of the oxygen molecules necessary to completely combust the fuel are provided by the oxygen passed into the furnace.

Utilizing the burner illustrated FIG. 1, the velocities of the oxidants (air and oxygen) are not the critical parameters. The velocity of fuel becomes a dominant factor. For process requirements, especially to achieve low $NO_x$ emissions, the fuel velocity should be at least 200 ft/sec, preferably at least 300 ft/sec most preferably at least 400 ft/sec.

The invention has advantages in that it makes it easy to convert an existing air-fuel burner to oxy-fuel combustion. Further, the economics of using oxygen can be effectively controlled based on the processing requirements and economic conditions, such as the pricing of oxygen and fuel.

FIG. 2 shows an air-fuel burner formed by an outer conduit 112 with an interior conduit 114 through which the fuel is supplied. In FIG. 2, an oxygen lance 116 is mounted in the interior of the fuel conduit 114. The nozzle end of the lance extends beyond the conduits 112, 114 forming the air burner. In FIG. 2, oxygen is injected through the nozzle 120 of the lance into the furnace or combustion zone and it mixes with (i) the fuel from the annular fuel passage 126 (formed between the inner surface of conduit 114 and the outer surface of lance 116) that surrounds the lance and (ii) the air from the annular passage 124 (formed between the outer surface of conduit 114 and the inner surface of conduit 116) that surrounds the fuel passage 126.

The oxygen lance illustrated in FIG. 2 has two features, a high velocity oxygen jet from lance 116 and a low velocity air stream from passage 124. The high velocity oxygen jet from lance 116 enhances the aspiration of the surrounding combustion products 118, i.e. furnace gases, prior to mixing and combusting with the fuel provided by the existing air burner. The low velocity air stream provides flame stabilization. The amount of air provided by the existing air burner can be adjusted depending on the process requirements and production rate needed. The total amount of air and oxygen is controlled to be about 3 to 5 percent in excess of the stoichiometric amount needed to completely combust the fuel.

The preferred mode of operation is to provide a minimum amount of air for cooling purposes and a maximum amount of oxygen through the lance for combustion. Under these conditions, higher thermal efficiency, improved heat transfer, maximum furnace gas recirculation/aspiration, and lower $NO_x$ emissions can be achieved. The burner illustrated in FIG. 2 can be considered as providing a kind of staged combustion. The old air-fuel burner is operated under a substoichiometric condition creating a fuel-rich zone immediately in front of the burner. The unburned fuel and the combustion products resulting from the combustion of the air and fuel will then be aspirated into the oxygen jets which already have been diluted with furnace gases. Complete combustion occurs at a certain distance away from the burner front. This high velocity oxygen lance enhances overall furnace recirculation, lowers peak flame temperature and avoids hot spots and furnace refractory damage. It will provide a desirable temperature distribution and result in low $NO_x$ emissions. The velocity of the oxygen injected through the nozzle 120 should be at least 300 ft/sec, and preferably is more than 500 ft/sec. For aluminum melting, dross formation can be controlled even at a higher production rate. It could be reduced on a basis of pound of dross formed per pound of product. This is an important economic factor in the aluminum industry.

The lance illustrated in FIG. 2 may also provide a low velocity oxygen stream which acts as a flame stabilizer or flame holder. This is especially important when the burner is operated as an oxy-fuel burner with a minimum amount of air input and when the furnace is started up below the self-ignition temperature.

Specific features of the invention are shown in one or more of the drawings for convenience only, as each feature may be combined with other features in accordance with the invention. Alternative embodiments will be recognized by those skilled in the art and are intended to be included within the scope of the claims.

I claim:

1. A dual oxidant burner comprising:

an inner conduit communicating with a source of fuel, through which fuel flows, and having a nozzle at its exit end;

an outer conduit surrounding at least a portion of the length of said inner conduit and an intermediate conduit between said inner and outer conduits, the inner and intermediate conduits defining a first passage between said inner and intermediate conduits communicating with a source of oxygen, and the intermediate and outer conduits defining a second passage between said intermediate and outer conduits communicating with a source of air, each of said first and second passages having an outlet end adjacent said nozzle;

each of said first and second passages conveying respective oxidants to mix beyond the outlet ends thereof with the fuel from the nozzle wherein the outlet end of the first passage extends beyond the outlet end of said second passage and the nozzle extends beyond the outlet end of the first passage.

2. A combustion method employing dual oxidants comprising:

(A) passing fuel at a high velocity into a combustion zone containing furnace gases and aspirating furnace gases into the high velocity fuel;

(B) passing oxygen at a lower velocity than that of the fuel into the combustion zone in a stream annular to the fuel, (C) passing air at a lower velocity than that of the fuel into the combustion zone in a stream annular to the oxygen;

(D) mixing oxygen and air with the mixture of fuel and furnace gases to form a combustible mixture; and (E) combusting the combustible mixture within the combustion zone.

3. The method of claim 2 wherein the fuel has a velocity equal to or greater than 400 feet per second when it is passed into the combustion zone.

4. The method of claim 2 wherein at least 80 percent of the oxygen molecules necessary to completely combust the fuel are provided by the oxygen passed into the combustion zone in step (B).

* * * * *